US006935630B2

(12) United States Patent
Giegerich

(10) Patent No.: US 6,935,630 B2
(45) Date of Patent: Aug. 30, 2005

(54) PORTABLE GAME BOARD

(75) Inventor: Paul Giegerich, Laverock, PA (US)

(73) Assignee: DMI Sports, Inc., Fort Washington, PA (US)

( * ) Notice: Subject to any disclaimer, the term of this patent is extended or adjusted under 35 U.S.C. 154(b) by 0 days.

(21) Appl. No.: 10/757,892

(22) Filed: Jan. 15, 2004

(65) Prior Publication Data

US 2004/0150160 A1 Aug. 5, 2004

Related U.S. Application Data

(60) Provisional application No. 60/440,713, filed on Jan. 16, 2003.

(51) Int. Cl.[7] ..... A63F 3/00
(52) U.S. Cl. ..... 273/239; 273/287; 273/309
(58) Field of Search ..... 273/239, 285, 273/286, 287, 148 R, 309

(56) References Cited

U.S. PATENT DOCUMENTS 4,015,778 A * 4/1977 Chen et al. ..... 273/284
4,967,925 A * 11/1990 Feniello ..... 220/524
5,280,913 A * 1/1994 Sirk ..... 273/261

FOREIGN PATENT DOCUMENTS

GB 2254565 A * 10/1992 ..... A63F/3/02

* cited by examiner

*Primary Examiner*—Vishu K. Mendiratta
(74) *Attorney, Agent, or Firm*—Akin Gump Strauss Hauer & Feld, LLP

(57) ABSTRACT

A first portable game board is formed by a combination of a collapsible table and at least one panel connectable to the table and having at least one game board pattern disposed on a first side of the panel. A second portable game board is formed by a combination of a sleeve having a game board pattern disposed on at least one side of the sleeve and a panel insert. The second portable game board may be further combined with the collapsible table.

16 Claims, 6 Drawing Sheets

PORTABLE GAME BOARD

CROSS-REFERENCE TO RELATED APPLICATIONS

This application claims benefit of U.S. Provisional Patent Application 60/440,713, "Portable Travel Games with Interchangeable Playing Surfaces", filed Jan. 16, 2003.

BACKGROUND OF THE INVENTION

The present invention relates generally board games and more particularly to portable board games.

Game boards on which board games are played are well known in the art. Typically, game boards are produced with a single distinct game board pattern (e.g. a checkerboard) disposed on a first side of a rigid board fabricated from wood, metal, cardboard or polymeric material. The board may be hinged to enhance its portability. A second distinct game board pattern (e.g. backgammon) may be disposed on a second opposing side of the board. It is further known in the art to provide game boards disposed on flexible materials, such that the game board may be rolled into a cylinder or other shape for easy transport. Game boards disposed on either rigid boards or flexible materials both typically require a supporting structure, generally not easily transportable, to support the game board at a comfortable elevation for play. Collapsible tables are known in the art. A need exists, however, for the combination of an easily portable game board and an easily portable supporting structure.

It is further known in the art to provide game boards disposed on rigid boards wherein either the board material is itself magnetized or wherein separate magnets are incorporated into the board. A needs exists for a game board which is both flexible for easy transport and which also is magnetic. Still further, a need exists for the combination of an easily portable magnetic game board and easily portable supporting structure.

It is yet further known in the art to provide a game board, either rigid or flexible, with two distinct game board patterns disposed on opposing sides. A need exists for a game board which provides additional game board patterns in a single component.

BRIEF SUMMARY OF THE INVENTION

Briefly stated, in a first aspect the invention is a combination forming a portable game board. The combination comprises a collapsible table having a frame formed from a plurality of pivotally connected frame members. The frame has a first end and a second end, and the frame is movable between an expanded configuration and a collapsed configuration. At least a first panel is releasably connectable to the collapsible table proximate the first end. The first panel has a first game board pattern disposed on a first side thereof.

In a second aspect the invention is a combination forming a portable game board. The combination comprises a panel insert and a sleeve. The sleeve has a first portion and a second portion, the first and second portions each having first and second sides and a plurality of edges. The first and second portions are fixedly connected in face to face engagement along all but one unconnected edge to form a pocket. A closure is provided along the unconnected edge to selectively open and close the pocket. The game board sleeve has at least one game board pattern disposed on at least one side of the first and second portions. The pocket is sized and shaped to releasably receive the panel insert.

BRIEF DESCRIPTION OF THE SEVERAL VIEWS OF THE DRAWINGS

The following detailed description of preferred embodiments of the invention will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figures 1, 1A:
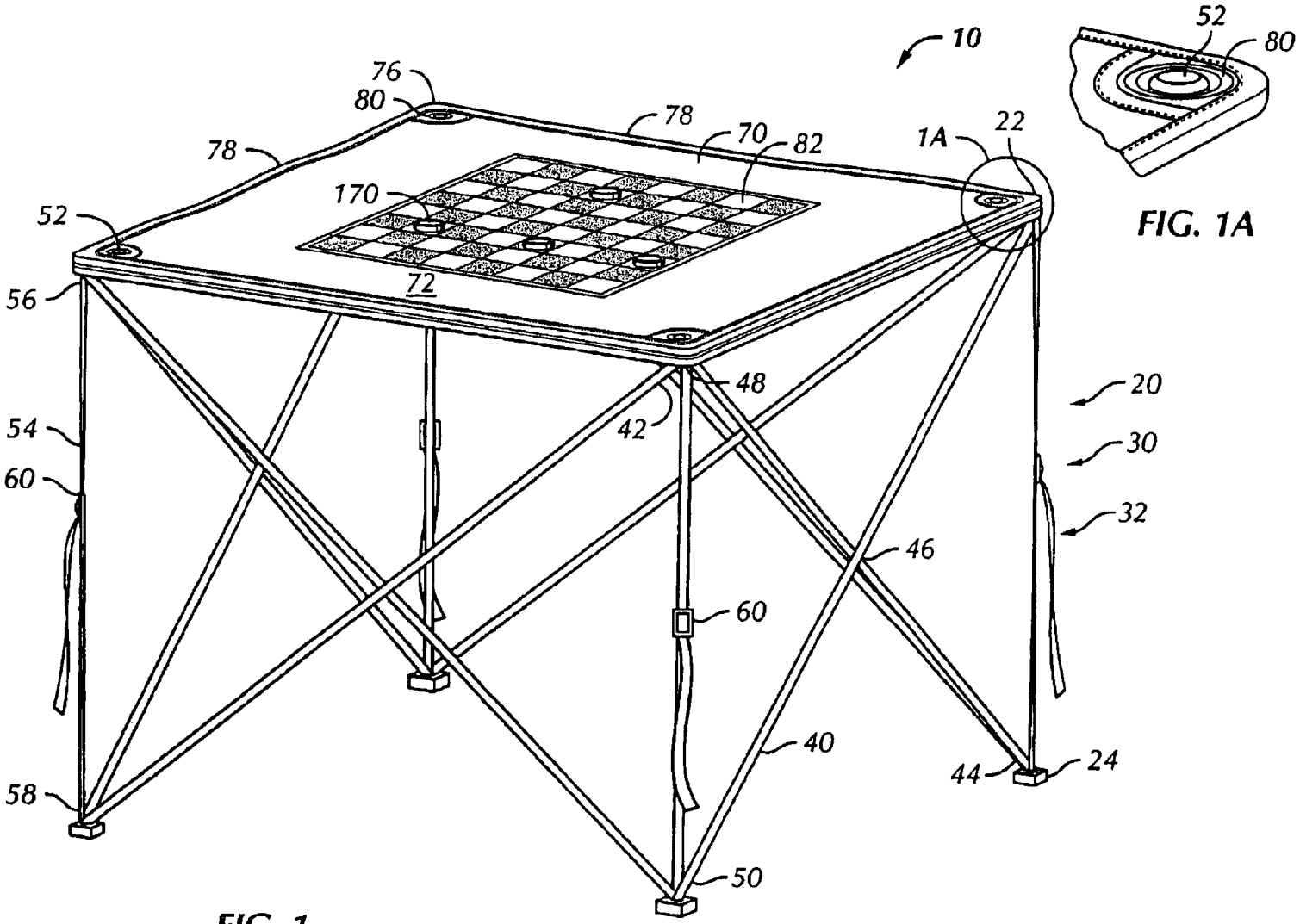
FIG. 1 is a perspective view of a combination of a collapsible table and a panel in accordance with a first preferred embodiment of the present invention.
FIG. 1A is an enlarged detail view of a corner of the combination of FIG. 1.
Figure 2:
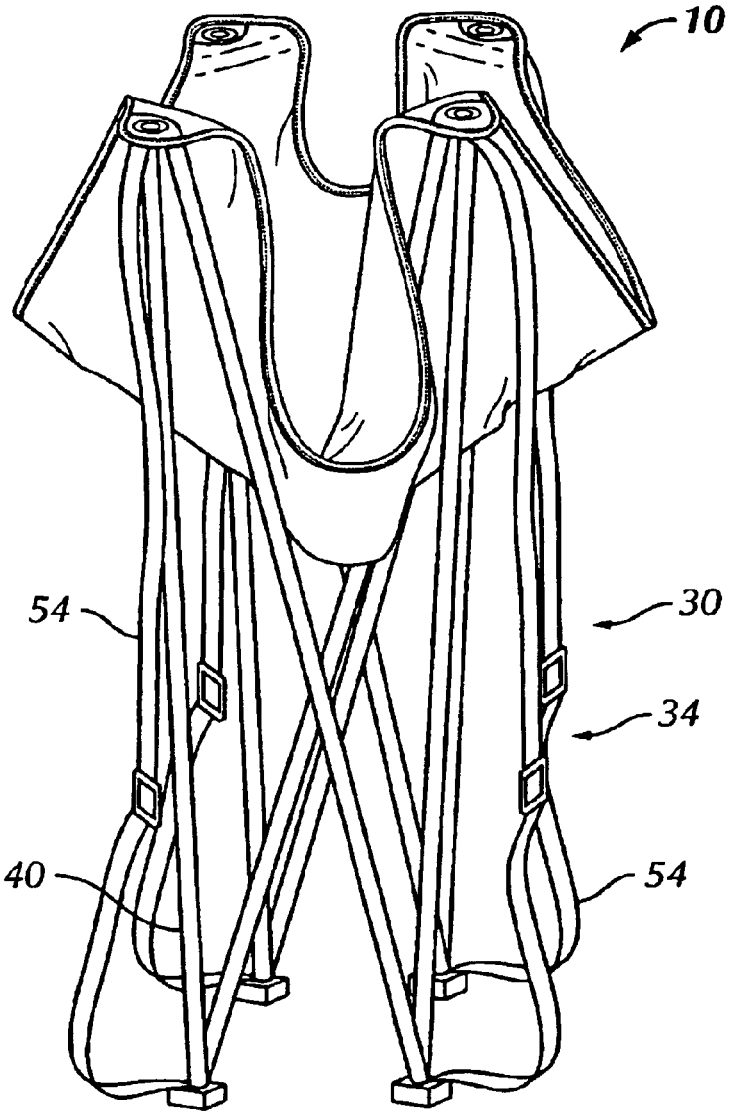
FIG. 2 is a perspective view of the collapsible table of FIG. 1, shown in a collapsed configuration and with the panel attached.
Figure 2A:
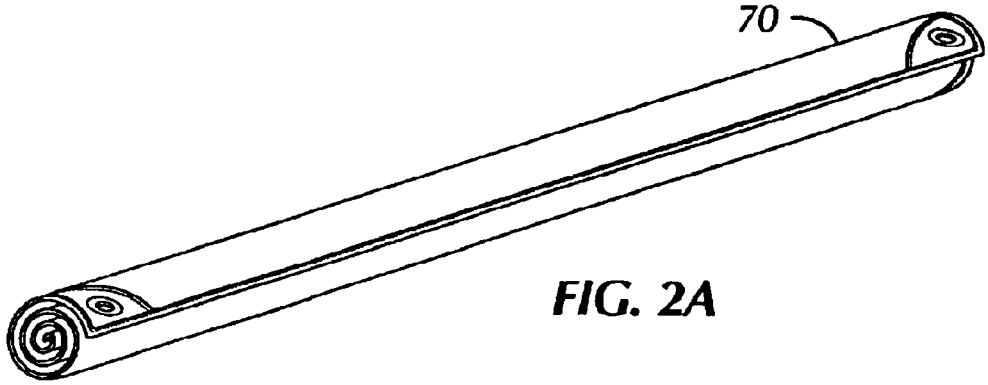
FIG. 2A is a perspective view of the panel of FIG. 1, shown disassembled from the collapsible table of FIG. 1 and in a rolled-up configuration.

Referring to the drawings, wherein like reference numerals are used to designate the same components throughout the several figures, there is shown in FIGS. 1 and 2 in accordance with a first preferred embodiment of the present invention a combination of a collapsible and portable table 20 and a panel 70 having a first game board pattern 82 disposed on a first side 72 thereof. The combination forms a first portable game board 10. The table 20 comprises a frame 30, shown in FIG. 1 in an expanded or use configuration 32 and shown in FIG. 2 in a collapsed or storage/transport configuration 34. The first panel 70 connects to the table 20 at an upper end 22. At a lower end 24, the table 20 rests on a supporting surface.

The frame 30 is formed from eight pivotally connected frame members 40 and four vertical strap members 54. The frame members 40 each have a first, upper end 42 and an second, lower end 44. Each frame member 40 is pivotally connected to a first, upper joint 48 at the first, upper end 42, a second, lower joint 50 at the second, lower end 44 and to a third, mid-span joint 46 at a point intermediate the first and second ends 42, 44, preferably near a midpoint of the frame member 40. Pins 52, the function of which is described herein below, extend upwardly from the upper joints 48. The frame members 40 are preferably fabricated from aluminum or steel tubing, although other metallic, wood, polymeric or composite materials could be substituted.

The straps 54 each connect at a first upper end 56 with an upper joint 48 and at a second lower end 58 with a lower joint 50. The straps 54 are adjustable in length, preferably with a conventional buckle 60. When sufficiently tightened, the straps 54 hold the frame members 40 generally rigidly in the expanded configuration 32. Alternatively, if loosened sufficiently, the straps 54 allow each upper joint 48 to move away from the adjacent lower joint 50, thus allowing the frame members 40 to pivot relative to one another into the collapsed configuration 34. In a preferred embodiment, the straps 54 are fabricated from nylon webbing. From this disclosure, the artisan will recognize that other flexible materials having good tensile strength could be substituted.

In the embodiment illustrated, the first panel 70 is of a generally square shape, with a first side 72, a second side 74, four corners 76, and four edges 78. The first panel 70 is preferably removably attachable to the frame 30. Alternatively, the panel 70 could be fixedly attached to the frame 30. In the embodiment illustrated, a grommet 80 is disposed at each of the four corners 76 of the first panel 70. When the four grommets 80 are assembled over the four pins 52 at the four corners of the frame 30, as is shown in the detail FIG. 1A, and the frame 30 is in the expanded configuration 32, the first panel 70 is stretched taut and is supported by the four pins 52 and the frame 30.

Figure 3:
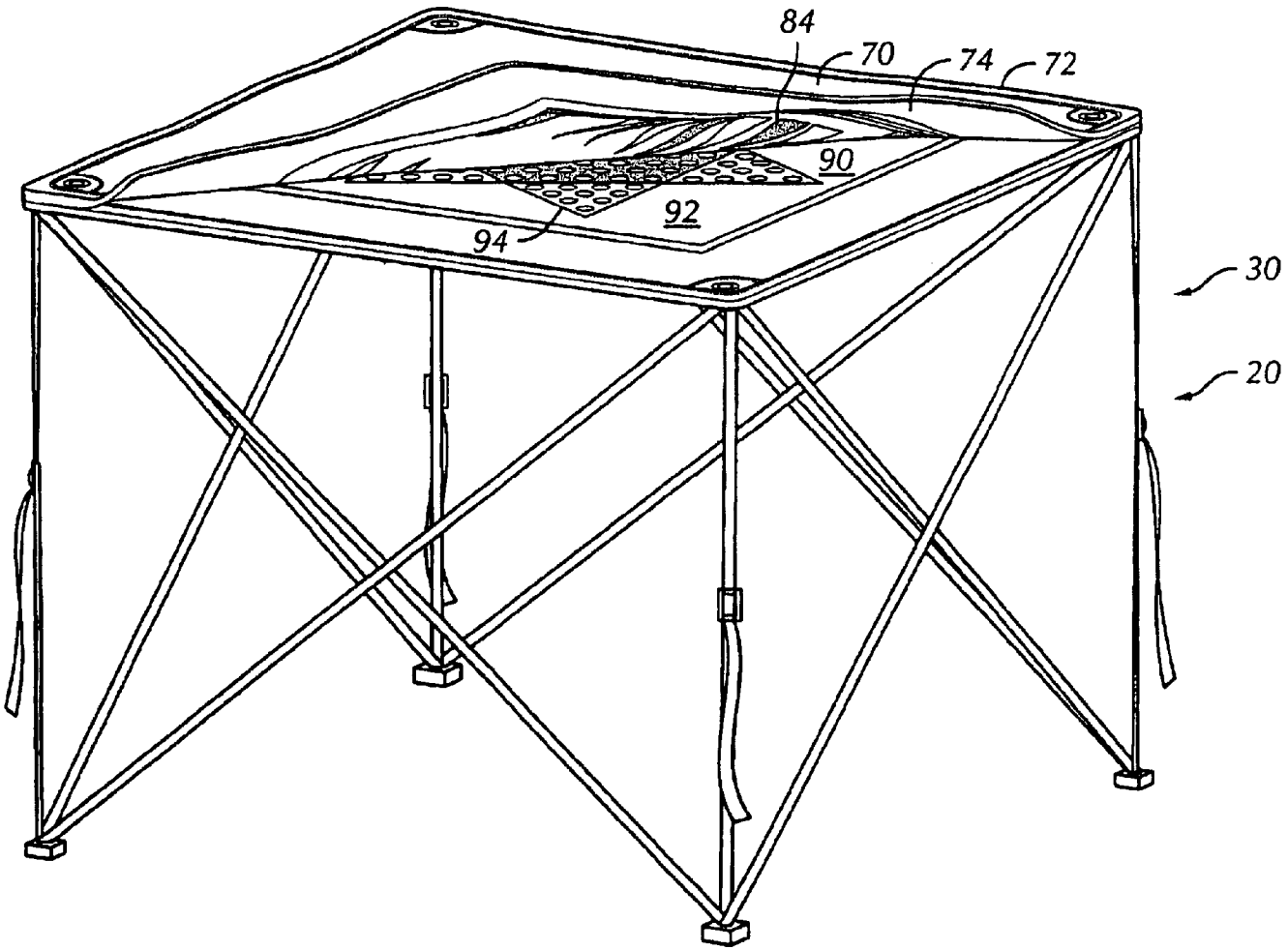
FIG. 3 is a perspective view of the collapsible table and first panel of FIG. 1, in further combination with a second panel, in accordance with a second preferred embodiment of the present invention.

A first game board pattern 82 is disposed on the first side 72 of the first panel 70. In FIG. 1, the game board pattern 82 is suggestively illustrated to be a checkerboard pattern suitable for use with the board games of checkers or chess. Game pieces 170, in particular, checkers are also illustrated in FIG. 1. With reference to FIG. 3, the first panel 70 may be provided with a second game board pattern 84 on the second side 74. The second game board pattern 84 in the present embodiment is suggestively illustrated to correspond to the board game backgammon.

The collapsible table 20 and first panel 70 are shown in FIG. 1 assembled and ready for play activities and are shown in FIG. 2 with the frame 30 in the collapsed configuration 34. The first panel 70 is shown assembled with the frame 30 in FIG. 2, and if the first panel 70 were to be permanently attached to the frame 30, the first embodiment game board 10 would be ready for storage and/or transport in the configuration illustrated in FIG. 2. If the first panel 70 is releasably attachable to the frame 30, then the first panel 70 may be disassembled from the frame 30 and rolled up for storage and/or transport. The frame 30 is movable from the expanded configuration 32 into the collapsed configuration 34 by loosening of the straps 54 and pushing the frame members 40 toward each other.

The first panel 70 is preferably fabricated from a durable, resilient and flexible fabric material capable of receiving imprinting such as the material sold under the trademark CORDURA®, although other materials could be substituted.

With reference now to FIG. 3, in a second preferred embodiment of the present invention, a second panel 90 may be provided and attached to the table 20 along with the first panel 70. The second panel 90 is generally similar to the first panel 70 as described above, including having a first side 92 with a third game board pattern 94, suggestively illustrated to be the pattern associated with the board game Chinese checkers. The second panel 90 could further be provided with a fourth game board pattern (not shown) on the second side (not shown) of the second panel 90. The second panel 90 need not have additional game board patterns disposed thereon, and may be used simply to provide additional stability to the first panel 70.

From this disclosure, the artisan would recognize that the first and second panels 70 and 90 could be temporarily or permanently attached to the table frame 30 using a variety of techniques, including snap button connectors or clip connectors.

In use, the table frame 30 is placed in the assembled configuration 32. The first, second, or first and second panels 70, 90 are assembled with the frame 30, installing the grommets 80 over the pins 52. The straps 54 are tightened sufficiently to obtain a rigid or semi-rigid, taut and stable playing surface suitable for play. A user may then proceed to use the board game pattern facing upwardly to engage in the game associated with that upwardly facing board game pattern.

Figure 4:
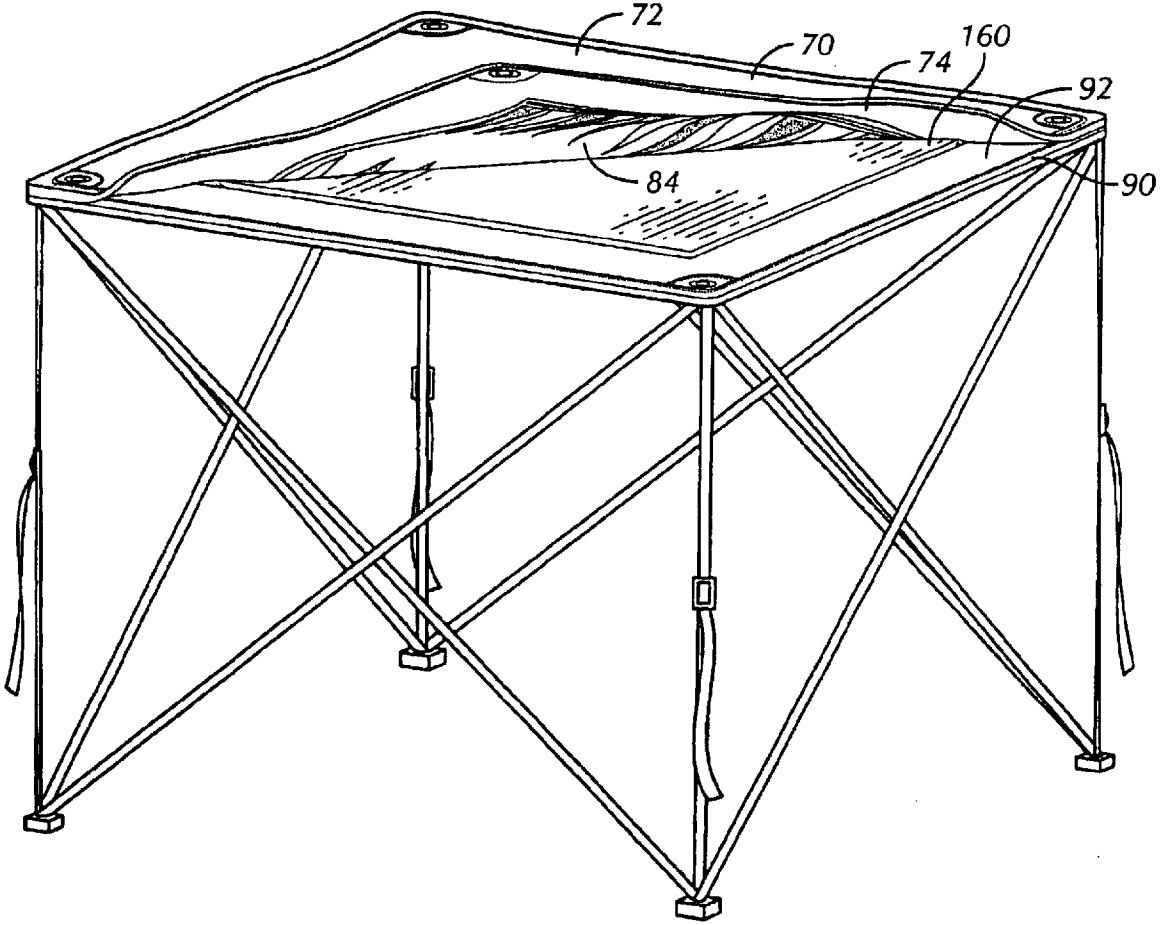
FIG. 4 is a perspective view of the combination of FIG. 3, further comprising a panel insert positioned between the first and second panels, in accordance with a third preferred embodiment of the present invention.

With reference now to FIG. 4, a third preferred embodiment of the present invention comprises the collapsible table 20 and first and second panels 70, 90 of the second preferred embodiment, and further comprises a generally flat panel insert 160 sized and shaped to be inserted between the first and second panels 70, 90. Preferably, the panel insert 160 is fabricated from a flexible material, capable of being rolled for easy transport. When installed between the first and second panels 70, 90, the panel insert 160 provides additional rigidity to the board game playing surface. Alternatively, the panel insert 160 could be rigid, fabricated from a rigid material such as a polymeric material, wood or metal. Furthermore, the panel insert 160 is preferably magnetic, for example, being fabricated from a polymer substrate, into which a ferro-magnetic (iron) powder is mixed. Further still, the game pieces 170 are preferably capable of being attracted by a magnet, which allows the game pieces 170 to releaseably adhere to the board game playing surface. Alternatively, the game pieces 170 could be provided with magnets, and the panel insert 160 made to be attracted by a magnet to achieve the same result.

Figure 5:
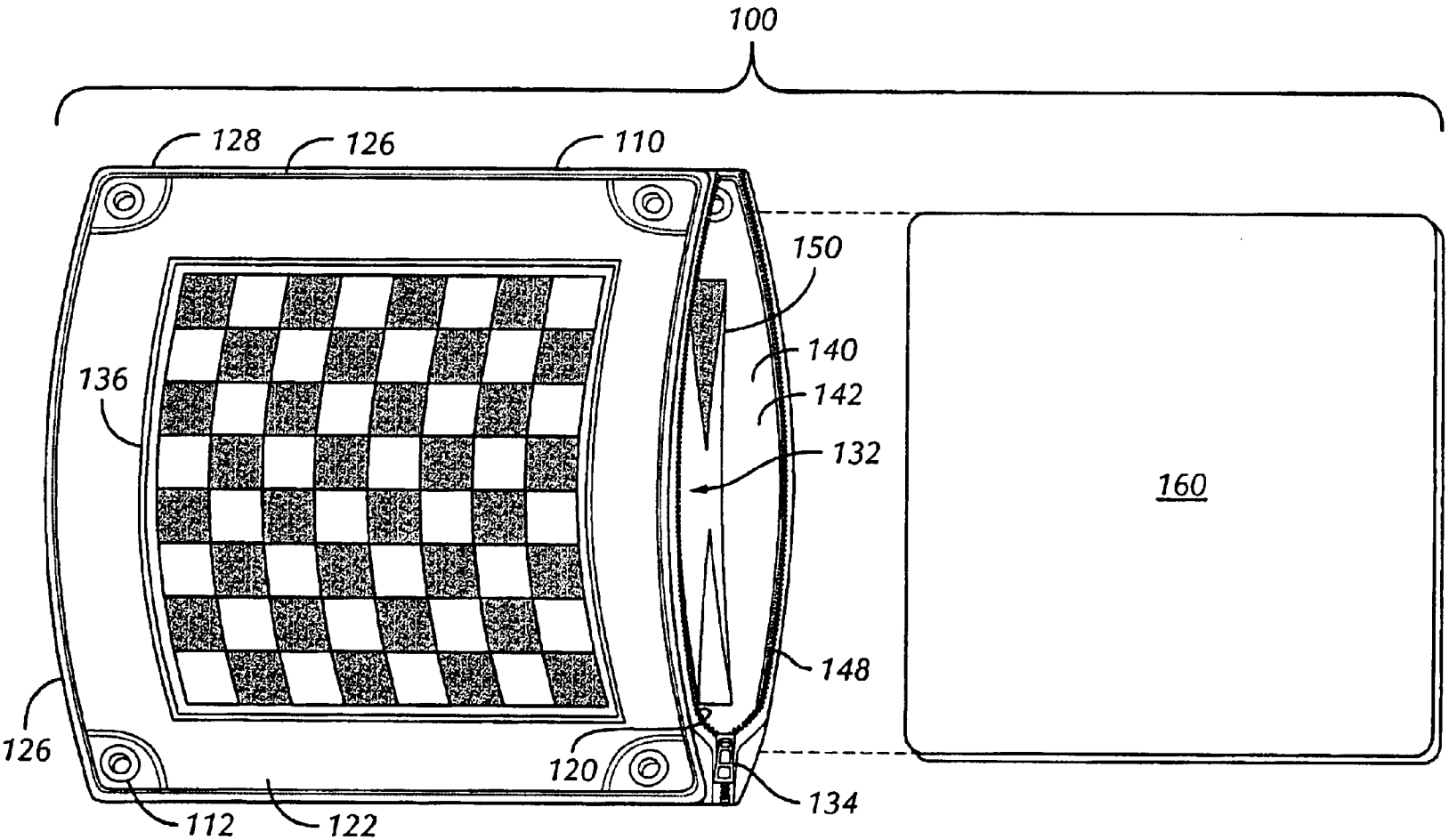
FIG. 5 is a top plan view of a combination of a sleeve and a panel insert in accordance with a fourth preferred embodiment of the present invention.

With reference now to FIG. 5, a fourth preferred embodiment of the present invention comprises the panel insert 160 of the third preferred embodiment, along with a sleeve 110 into which the panel insert 160 may be installed. Together, the sleeve 110 and panel insert 160 form a combination providing a second portable game board 100.

The sleeve 110 has a first portion 120, having a first side 122 (upon which a first board game pattern 136 is disposed) and a second side (not shown). The sleeve 110 further has a second portion 140, also having a first side 142 (upon which a second game board pattern 150 is disposed) and a second side (not shown). Each side has a plurality of edges 126. The first and second portions 120, 140 are fixedly connected in face to face engagement along all but one unconnected edge 130, 148 to form a pocket 132. A closure 134 is provided along the unconnected edge 130 to selectively open and close the pocket 132. The closure 134 may be a hook and loop fastener, such as that sold under the trademark VELCRO®, at least one button and button hole, or a zipper.

The sleeve 110 has four major planar surfaces formed by the first and second sides of the first and second portions 120, 140, respectively. Two of the planar surfaces are on the exterior of the sleeve 110 and two of the planar surfaces are on the interior of the sleeve 110 at any given time when the sleeve is laid flat. The interior planar surfaces are exposed when the sleeve 110 is turned inside out. Preferably, each of the four planar sides preferably has a distinct game board pattern disposed thereon. Note that the game pieces 170 may be stored inside the sleeve 110 when the second portable game board 100 is not being used for play activities. The sleeve 110 is preferably fabricated from a durable, resilient and flexible cloth material suitable for imprinting, such as the material sold under the trademark CORDURA®, although other materials could be substituted.

Figure 6:
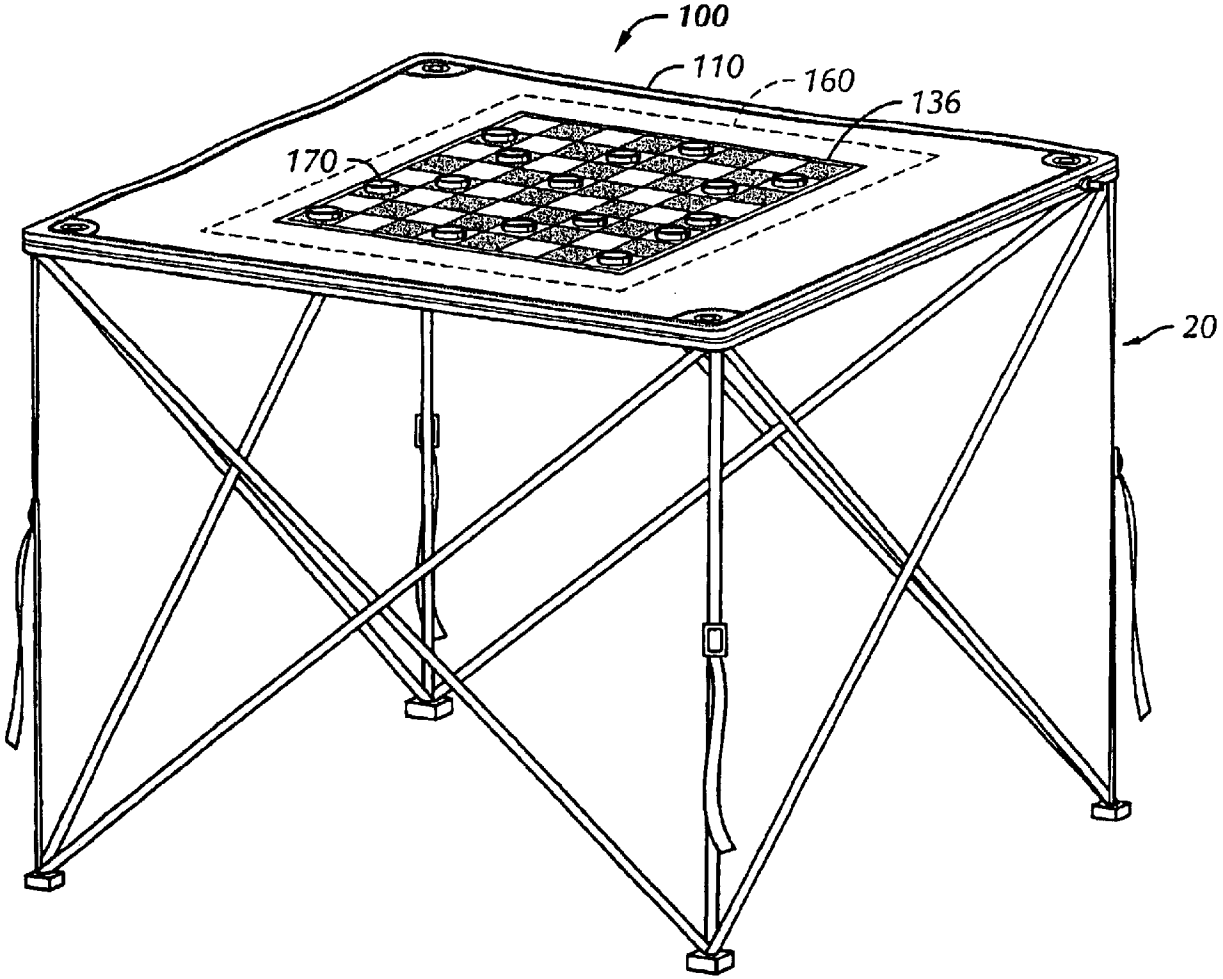
FIG. 6 is a perspective view of the combination of the sleeve and panel insert of FIG. 5, in further combination with the collapsible table of FIGS. 1–4, in accordance with a fifth preferred embodiment of the present invention.

From this disclosure, the artisan will recognize that it is possible to use the second portable game board 100 independently of the table 20. However, with reference to FIG. 6, it is also possible to combine the second portable game board 100 with the table 20 disclosed herein, for example by providing the sleeve 110 with grommets 112, as a fifth embodiment of the present invention.

From the foregoing it can be seen that the present invention comprises in first, second, and third embodiments the combination of a collapsible and portable table and at least one panel which is releasably attachable to the table, providing a game board which is easily transported. In a fourth embodiment, the invention comprises a sleeve comprising multiple game board designs. The sleeve may be combined with a flexible panel insert or a rigid panel insert. The panel insert may be magnetic. In a fifth embodiment, the invention comprises the combination of the sleeve and panel insert of the fourth embodiment and the collapsible table of the first, second and third embodiments. It will be appreciated by those of ordinary skill in the art that modifications may be made to the above described embodiments without departing from the scope and spirit of the present invention

I claim:

1. A combination forming a portable game board, the combination comprising:

a collapsible table having a frame formed from a plurality of pivotally connected frame members, the frame having a first end and a second end, and the frame being movable between an expanded configuration and a collapsed configuration;

at least a first panel releasably connectable to the collapsible table proximate the first end, the first panel having a first game board pattern disposed on a first side thereof, the first panel is fabricated from a non-rigid material;

a second panel releaseably connectable to the collapsible table proximate the first end, adjacent the first panel;

a magnetized panel insert sized and shaped to fit between the first and second panels; and a plurality of game pieces, each of the game pieces including a material capable of being attracted by a magnet.

2. The combination of claim 1 wherein the non-rigid material is a fabric material.

3. The combination of claim 1, the first panel having a second game board pattern disposed on a second side thereof.

4. The combination of claim 1, the frame further comprising a plurality of protruding pins and the panel further comprising a corresponding plurality of grommets, whereby engagement of the grommets with the pins releaseably connects the panel to the frame.

5. A combination forming a portable game board, the combination comprising:

a collapsible table having a frame formed from a plurality of pivotally connected frame members, the frame having a first end and a second end, and the frame being movable between an expanded configuration and a collapsed configuration; and at least a first panel releasably connectable to the collapsible table proximate the first end, the first panel having a first game board pattern disposed on a first side thereof, each of the plurality of frame members is pivotally connected at a first end of the frame member to a first joint and at a second end of the frame member to a second joint and at a point intermediate the first and second ends to an other frame member at a third joint, wherein the frame further comprises a plurality of corner straps, each corner strap being vertically connected between the first joint and the second joint.

6. The combination of claim 5 wherein the corner straps are adjustable in length and capable of being tightened.

7. A combination forming a portable game board, the combination comprising:

a panel insert;

a sleeve including a first portion and a second portion, the first and second portions each having first and second sides and a plurality of edges, the first and second portions being fixedly connected in face to face engagement along all but one unconnected edge to form a pocket, a closure along the unconnected edge to selectively open and close the pocket, wherein the game board sleeve has at least one game board pattern disposed on at least one side of the first and second portions, the pocket is sized and shaped to releaseably receive the panel insert; and a collapsible table including a frame formed from a plurality of pivotally connected frame members, the frame being movable between an expanded configuration and a collapsed configuration a plurality of protruding pins, wherein the sleeve further includes a corresponding plurality of grommets, whereby engagement of the grommets with the pins releaseably connects the sleeve to the frame.

8. The combination of claim 7 wherein the sleeve is fabricated from a flexible material.

9. The combination of claim 8 wherein the flexible material is a fabric.

10. The combination of claim 7 wherein the panel insert is magnetized.

11. The combination of claim 10 in further combination with a plurality of game pieces each game piece including a material capable of being attracted by a magnet.

12. The combination of claim 7 wherein the panel insert is flexible and capable of being rolled and unrolled.

13. The combination of claim 7 wherein the panel insert is capable of being attracted by a magnet.

14. The combination of claim 13 in further combination with a plurality of game pieces, each game piece including a magnetized material.

15. The combination of claim 7 wherein the panel insert is rigid.

16. The combination of claim 7 wherein game board patterns are disposed on the first and second side of the first portion and on the first and second sides of the second portion of the sleeve.

* * * * *